US010353314B2

(12) United States Patent
Takino

(10) Patent No.: US 10,353,314 B2
(45) Date of Patent: Jul. 16, 2019

(54) IMAGE FORMING APPARATUS INCLUDING A DEVELOPING UNIT WITH LUMINESCENT TONER

(71) Applicant: Oki Data Corporation, Tokyo (JP)

(72) Inventor: Yuji Takino, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/626,773

(22) Filed: Jun. 19, 2017

(65) Prior Publication Data

US 2017/0371261 A1 Dec. 28, 2017

(30) Foreign Application Priority Data

Jun. 28, 2016 (JP) ..... 2016-127428

(51) Int. Cl.

| | |
|---|---|
| ***G03G 9/09*** | (2006.01) |
| ***G03G 9/12*** | (2006.01) |
| ***G03G 15/00*** | (2006.01) |
| ***G03G 15/01*** | (2006.01) |
| ***G03G 15/08*** | (2006.01) |

(52) U.S. Cl.

CPC ..... *G03G 15/0121* (2013.01); *G03G 9/0926* (2013.01); *G03G 15/6585* (2013.01); *G03G 9/09* (2013.01); *G03G 9/0902* (2013.01); *G03G 9/0928* (2013.01); *G03G 15/08* (2013.01)

(58) Field of Classification Search

CPC ..... G03G 9/09; G03G 9/0902; G03G 9/0926; G03G 9/0928; G03G 9/122; G03G 15/08; G03G 15/0121

See application file for complete search history.

(56) References Cited

U.S. PATENT DOCUMENTS

| | | | | |
|---|---|---|---|---|
| 2012/0202022 | A1 | 8/2012 | Schulze-Hagenest | |
| 2013/0164008 | A1* | 6/2013 | Shimmura | G03G 15/6585 399/53 |
| 2013/0294801 | A1* | 11/2013 | Tyagi | G03G 15/0126 399/223 |
| 2014/0341615 | A1* | 11/2014 | Yamashita | G03G 9/0819 399/223 |
| 2015/0024169 | A1 | 1/2015 | Martin | |

(Continued)

FOREIGN PATENT DOCUMENTS

| | | | |
|---|---|---|---|
| AU | 2014-200724 | A1 | 3/2014 |
| EP | 1883519 | A2 | 2/2008 |

(Continued)

*Primary Examiner* — Joseph S Wong

(74) *Attorney, Agent, or Firm* — Rabin & Berdo, P.C.

(57) ABSTRACT

An image forming apparatus includes a developing unit, a transferring unit, and a fixing unit. The developing unit performs an attachment process in which the developing unit attaches a luminescent toner to a latent image that is formed on a basis of image data. The transferring unit performs a transfer process in which the transferring unit transfers, onto a medium, the luminescent toner attached to the latent image. The fixing unit performs a fixing process in which the fixing unit fixes, to the medium, the luminescent toner transferred onto the medium. The attachment process performed by the developing unit and the transfer process performed by the transferring unit are each performed plural times for the medium, on the basis of the image data.

14 Claims, 4 Drawing Sheets

(56) References Cited

U.S. PATENT DOCUMENTS

| | | | | |
|---|---|---|---|---|
| 2016/0103404 | A1* | 4/2016 | Hasegawa ..... | G03G 15/1605<br>399/313 |
| 2016/0216627 | A1 | 7/2016 | Hiraide | |

FOREIGN PATENT DOCUMENTS

| | | | |
|---|---|---|---|
| JP | H04-349474 | A | 12/1992 |
| JP | 2004-037564 | A | 2/2004 |
| JP | 2007-017719 | A | 1/2007 |

* cited by examiner

IMAGE FORMING APPARATUS INCLUDING A DEVELOPING UNIT WITH LUMINESCENT TONER

CROSS REFERENCE TO RELATED APPLICATIONS

The present application claims priority from Japanese Patent Application No. 2016-127428 filed on Jun. 28, 2016, the entire contents of which are hereby incorporated by reference.

BACKGROUND

The technology relates to an image forming apparatus that forms an image by utilizing a process of developing a toner.

An image forming apparatus using an electrophotographic scheme is in widespread use. One reason for this is that the image forming apparatus using the electrophotographic scheme is able to achieve a high-quality image in a short time, compared with an image forming apparatus using other scheme such as an inkjet scheme.

An image forming apparatus using the electrophotographic scheme includes a photosensitive drum, and forms an image on a surface of a medium by means of the photosensitive drum. Non-limiting examples of the medium may include paper. A process of forming an image involves formation of an electrostatic latent image on a surface of the photosensitive drum, which is followed by attachment of a toner to the formed electrostatic latent image. The toner attached to the electrostatic latent image is transferred onto the medium, and the toner transferred onto the medium is thereafter fixed to the medium.

For forming a color image, one or more toners having respective one or more colors are used. A toner that is able to emit light in response to application of ultraviolet light, i.e., a luminescent toner, is also used, and an image that is able to emit light, i.e., a luminescent image, is formed with the use of the luminescent toner, for example, as disclosed in Japanese Unexamined Patent Application Publication No. 2007-017719.

SUMMARY

A color of a luminescent toner easily fades over time. It is therefore desired to maintain the quality of a luminescent image as well as possible in a case of forming the luminescent image with the use of the luminescent toner.

It is desirable to provide an image forming apparatus that achieves a high-quality luminescent image.

According to one embodiment of the technology, there is provided an image forming apparatus that includes a developing unit, a transferring unit, and a fixing unit. The developing unit performs an attachment process in which the developing unit attaches a luminescent toner to a latent image that is formed on a basis of image data. The transferring unit performs a transfer process in which the transferring unit transfers, onto a medium, the luminescent toner attached to the latent image. The fixing unit performs a fixing process in which the fixing unit fixes, to the medium, the luminescent toner transferred onto the medium. The attachment process performed by the developing unit and the transfer process performed by the transferring unit are each performed plural times for the medium, on the basis of the image data.

DETAILED DESCRIPTION

Figure 1:
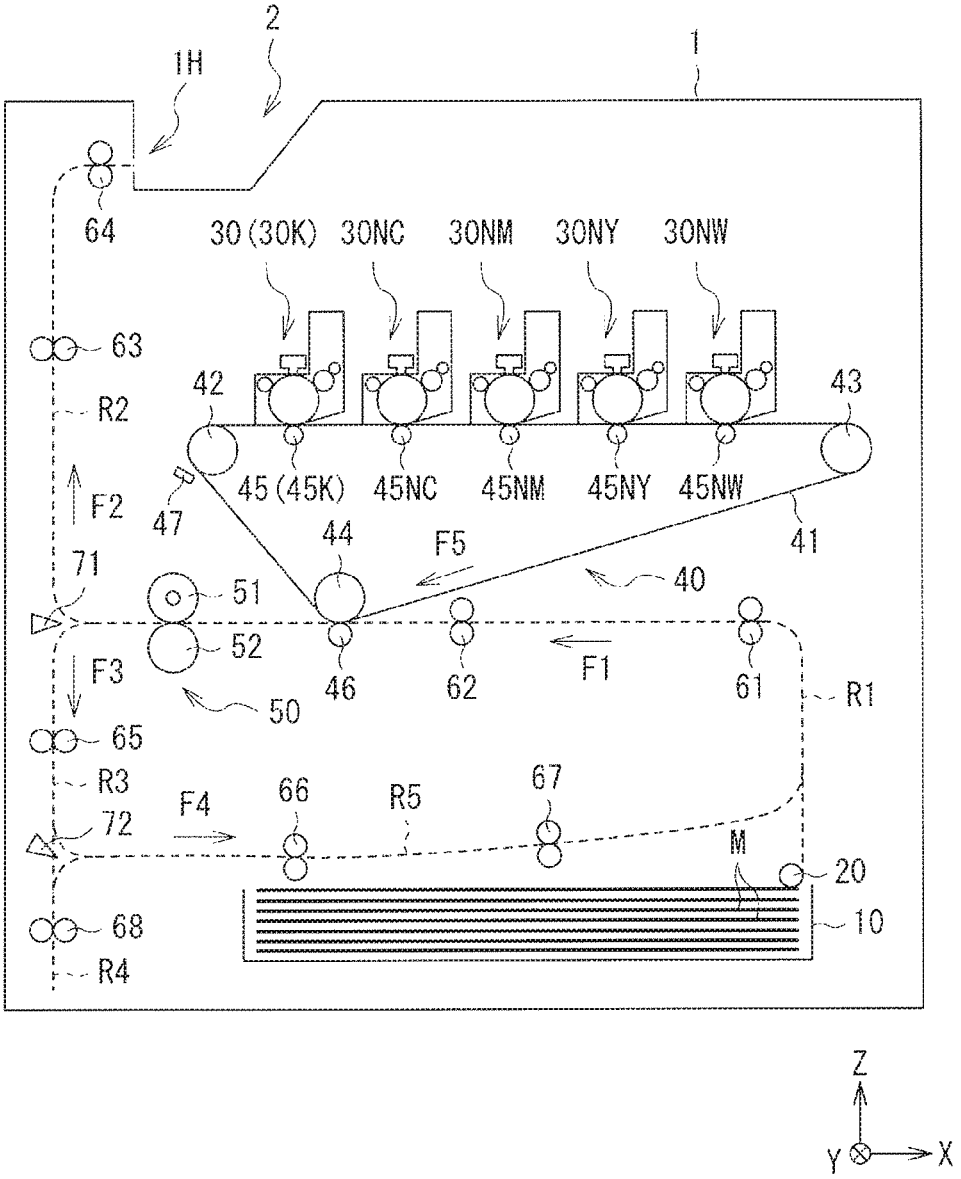
FIG. 1 is a plan view of an example of a configuration of an image forming apparatus according to one example embodiment of the technology.

Some example embodiments of the technology are described below in detail with reference to the drawings. The description is given in the following order.

1. Image Forming Apparatus
   1-1. Outline
   1-2. Overall Configuration
   1-3. Configuration of Developing Unit
   1-4. Configuration of Toner
   1-5. Operations
   1-6. Example Workings and Example Effects
2. Modification Examples

1. IMAGE FORMING APPARATUS

A description is given below of an image forming apparatus according to one example embodiment of the technology.

1-1. Outline

First, an outline of the image forming apparatus is described.

The image forming apparatus described below may be, for example, a full-color printer using an electrophotographic scheme. The image forming apparatus may form a luminescent image with the use of a luminescent toner on a surface of a medium M illustrated in FIG. 1 which will be described later, for example. It is to be noted that the image forming apparatus may also use a non-luminescent toner together with the luminescent toner to form the luminescent image.

A type of the luminescent toner, i.e., a color of the luminescent toner, is not particularly limited. Hence, only one type of luminescent toner, may be used, or two or more types of luminescent toners may be used. A type of the non-luminescent toner, i.e., a color of the non-luminescent toner, is not particularly limited. Hence, only one type of non-luminescent toner may be used, or two or more types of non-luminescent toners may be used. A material of the medium M is not particularly limited. For example, the material of the medium M may be one or more types of materials such as paper and a film.

The term "luminescent toner" as used herein refers to a toner that generates visible light owing to absorption of light such as invisible light upon reception of the light such as the invisible light. The type of the invisible light is not particularly limited. However, the invisible light may be one or more types of light such as ultraviolet light and infrared light. The type of the visible light is not particularly limited. However, the visible light may be one or more types of light such as fluorescent light, noctilucent light, and phosphorescent light, for example.

The term "non-luminescent toner" as used herein refers to a regular toner that generates no visible light upon reception of light such as invisible light, unlike the luminescent toner described above.

Hereinafter, the luminescent toner and the non-luminescent toner may be collectively and simply referred to as a "toner" in some cases.

The term "luminescent image" as used herein refers to an image that is formed with the use of the luminescent toner and therefore generates visible light by utilizing the luminescent toner.

In particular, the image forming apparatus is able to perform each of a development process and a transfer process plural times for the medium M on the basis of image data D as will be described later in greater detail. It is to be noted that the image forming apparatus may be able to perform a fixing process once or more for the medium M on the basis of the image data D as will be described later in greater detail.

In this example, the image forming apparatus may be able to perform an image forming process once or more for the same medium M on the same image data D, for example. The image forming process may include the development process, a primary transfer process, a secondary transfer process, and the fixing process. Accordingly, the image forming apparatus may have a plurality of image formation modes. The transfer process described above may include the primary transfer process and the secondary transfer process, for example.

Specifically, the image forming apparatus may have two types of image formation modes, i.e., a regular mode and a light resistance enhancement mode, for example. The regular mode may be an image formation mode that performs the image forming process only once for the medium M on the basis of the image data D. The light resistance enhancement mode may be an image formation mode that performs the image forming process twice or more for the medium M on the basis of the image data D. The light resistance enhancement mode may further include a plurality of image formation modes that have conditions different from each other in accordance with desired levels of light resistance. The forgoing conditions may include the number of the image forming process to be performed.

The regular mode may be used, for example, for a use that does not necessarily require high light resistance for the luminescent image. Non-limiting examples of the use of the regular mode may include a use for which mere formation of the luminescent image on the surface of the medium M is sufficient. In contrast, the light resistance enhancement mode may be used, for example, for a use that requires sufficient light resistance for the luminescent image. Non-limiting examples of the use of the light resistance enhancement mode may include formation of a certification image which requires the image quality to be maintained and formation of a luminescent image that is likely to be exposed to direct sunlight. Non-limiting examples of the luminescent image that is likely to be exposed to direct light may include an image used as a print on a T-shirt, more specifically, an image formed as a design on a surface of a T-shirt.

1-2. Overall Configuration

First, an overall configuration of the image forming apparatus is described.

FIG. 1 illustrates an example of a planar configuration of the image forming apparatus. The medium M may be conveyed along conveyance routes R1 to R5. Each of the conveyance routes R1 to R5 is illustrated by a dashed line in FIG. 1.

Referring to FIG. 1, the image forming apparatus may include, inside a housing 1, a tray 10, a feeding roller 20, one or more developing units 30, a transferring unit 40, a fixing unit 50, conveying rollers 61 to 68, and conveyance path switching guides 71 and 72, for example.

[Housing]

The housing 1 may include one or more types of materials such as a metal material and a polymer material, for example. The housing 1 may be provided with a stacker 2 to which the medium M provided with a formed image is to be discharged. The medium M provided with the formed image may be discharged from a discharge opening 1H provided in the housing 1.

[Tray and Feeding Roller]

The tray 10 may be attached detachably to the housing 1, for example. The tray 10 may contain the medium M. The feeding roller 20 may extend in a Y-axis direction and be rotatable around the Y-axis, for example. Each of the members referred to by the name including the term "roller" out of a series of members described below may extend in the Y-axis direction and be rotatable around the Y-axis, as with the feeding roller 20.

The tray 10 may contain a plurality of media M in a stacked state, for example. The media M contained in the tray 10 may be picked out one by one from the tray 10 by the feeding roller 20, for example.

Each of the number of the tray 10 and the number of the feeding roller 20 is not particularly limited, and may be only one or two or more. FIG. 1 illustrates an example case in which one tray 10 and one feeding roller 20 are provided.

[Developing Unit]

The one or more developing units 30 each perform an attachment process of a toner, i.e., a development process, with the use of the toner. The attachment process is a process of attaching the toner. Specifically, the one or more developing units 30 each may form a latent image and attach the toner to the formed latent image by utilizing Coulomb force. The latent image may be an electrostatic latent image, for example.

In this example, the image forming apparatus may include five developing units 30, for example. The five developing units 30 may include one developing unit 30 (30K) that performs the development process with the use of the non-luminescent toner, and four developing units 30 (30NC, 30NM, 30NY, and 30NW) that each perform the development process with the use of the luminescent toner, for example.

The developing units 30K, 30NC, 30NM, 30NY, and 30NW each may be attached detachably to the housing 1, and may be disposed along a traveling path of an intermediate transfer belt 41 which will be described later in greater detail, for example. In this example, the developing units 30K, 30NC, 30NM, 30NY, and 30NW may be disposed in order from the upstream toward the downstream in a traveling direction, illustrated by an arrow F5, in which the intermediate transfer belt 41 travels, for example.

The developing units 30K, 30NC, 30NM, 30NY, and 30NW may have similar configurations except for having toners different in type (color) from each other, for example. The toners each may be contained in a cartridge 38 which will be described later in greater detail referring to FIG. 2. The configuration of each of the developing units 30K, 30NC, 30NM, 30NY, and 30NW will be described later in greater detail.

[Transferring Unit]

The transferring unit 40 performs the transfer process with the use of the toners that have been subjected to the development process by the respective developing units 30. Specifically, the transferring unit 40 may transfer, onto the medium M, the toner attached to the electrostatic latent image by each of the developing units 30. The transfer process described in this example may include the primary transfer process and the secondary transfer process as described above, for example.

The transferring unit 40 may include the intermediate transfer belt 41, a driving roller 42, a driven roller (an idle roller) 43, a backup roller 44, one or more primary transfer rollers 45, a secondary transfer roller 46, and a cleaning blade 47, for example.

The intermediate transfer belt 41 may be a medium (an intermediate transfer medium) onto which the toner is temporarily transferred before the toner is transferred onto the medium M. The intermediate transfer belt 41 may be an elastic endless belt, for example. The intermediate transfer belt 41 may include one or more of polymer materials such as polyimide. The intermediate transfer belt 41 may be movable in response to rotation of the driving roller 42 while lying on the driving roller 42, the driven roller 43, and the backup roller 44.

The driving roller 42 may be rotatable with a drive source such as a motor. Each of the driven roller 43 and the backup roller 44 may be rotatable in response to the rotation of the driving roller 42, for example.

The one or more primary transfer rollers 45 each may transfer the toner attached to the electrostatic latent image onto the intermediate transfer belt 41. In other words, the one or more primary transfer rollers 45 each may perform primary transfer. The one or more primary transfer rollers 45 each may be so pressed against the corresponding developing unit 30 as to be in contact with the corresponding developing unit 30 with the intermediate transfer belt 41 in between. Specifically, the one or more primary transfer rollers 45 each may be so pressed against a photosensitive drum 31 in the corresponding developing unit 30 as to be in contact with the photosensitive drum 31 with the intermediate transfer belt 41 in between. The photosensitive drum 31 will be described later in greater detail referring to FIG. 2. The one or more primary transfer rollers 45 each may be rotatable in accordance with the traveling of the intermediate transfer belt 41.

In this example, the transferring unit 40 may include five primary transfer rollers 45, i.e., primary transfer rollers 45K, 45NC, 45NM, 45NY, and 45NW, corresponding to the five developing units 30, i.e., the developing units 30K, 30NC, 30NM, 30NY, and 30NW, for example. The transferring unit 40 may also include one secondary transfer roller 46 corresponding to the one backup roller 44.

The secondary transfer roller 46 may transfer, onto the medium M, the toner that has been transferred onto the intermediate transfer belt 41. In other words, the secondary transfer roller 46 may perform secondary transfer. The secondary transfer roller 46 may be so pressed against the backup roller 44 as to be in contact with the backup roller 44. The secondary transfer roller 46 may include a core member and an elastic layer, for example. The core member may include metal, for example. The elastic layer may include a foamed rubber layer that covers an outer peripheral surface of the core member, for example. The secondary transfer roller 46 may be rotatable in accordance with the traveling of the intermediate transfer belt 41.

The cleaning blade 47 may be so pressed against the intermediate transfer belt 41 as to be in contact with the intermediate transfer belt 41. The cleaning blade 47 may scrape off unnecessary remains of the toner on the surface of the intermediate transfer belt 41.

[Fixing Unit]

The fixing unit 50 performs the fixing process with the use of the toner that has been transferred onto the medium M by the transferring unit 40. Specifically, the fixing unit 50 may apply pressure on the toner that has been transferred onto the medium M by the transferring unit 40 while applying heat to the toner. The fixing unit 50 may thus fix the toner onto the medium M.

The fixing unit 50 may include a heating roller 51 and a pressurizing roller 52, for example.

The heating roller 51 may apply heat to the toner. The heating roller 51 may include a metal core and a resin coating, for example. The metal core may have a hollow cylindrical shape, for example. The resin coating may cover the surface of the metal core. The metal core may include one or more of metal materials such as aluminum, for example. The resin coating may include one or more of polymer materials such as a copolymer of tetrafluoroethylene and perfluoroalkylvinylether (PFA) and polytetrafluoroethylene (PTFE), for example.

A heater may be provided inside the metal core of the heating roller 51, for example. Non-limiting examples of the heater may include a halogen lamp. The surface temperature of the heating roller 51 may be detected by a thermistor that is provided at a position away from the heating roller 51, for example.

The pressurizing roller 52 may be so pressed against the heating roller 51 as to be in contact with the heating roller 51. The pressurizing roller 52 may apply a pressure to the toner. The pressurizing roller 52 may be a metal rod, for example. The metal rod may include one or more of metal materials such as aluminum, for example.

[Conveying Roller]

Each of the conveying rollers 61 to 68 may include a pair of rollers that face each other with corresponding one of the conveyance routes R1 to R5 of the medium M in between. Each of the conveying rollers 61 to 68 may convey the medium M that has been taken out by the feeding rollers 20.

In an example case where a luminescent image is to be formed only on single surface of the medium M, the medium M may be conveyed by the conveying rollers 61 to 64 along the conveyance routes R1 and R2. In another example case where luminescent images are to be formed on both surfaces of the medium M, the medium M may be conveyed by the conveying rollers 61 to 68 along the conveyance routes R1 to R5.

[Conveyance Path Switching Guide]

The conveyance path switching guides 71 and 72 each may switch a conveyance direction, of the medium M, in which the medium M is to be conveyed, depending on conditions such as a manner in which a luminescent image is formed on the medium M. The conditions on the manner in which a luminescent image is formed on the medium M may include whether the luminescent image is to be formed only on one surface of the medium M and whether the luminescent images are to be formed on both surfaces of the medium M, for example.

[Other Components]

The image forming apparatus may include one or more components other than the components described above, for example. The components other than the components described above are not particularly limited. However, non-limiting examples of such components may include a controller that controls an overall operation of the image forming apparatus, and an operation panel that is usable by a user to operate the image forming apparatus. This controller may include an electronic circuit such as a central processing unit (CPU), and control the series of processes (operations) of the image forming apparatus including the development process, the transfer process, and the fixing process described above.

1-3. Configuration of Developing Unit

Figure 2:
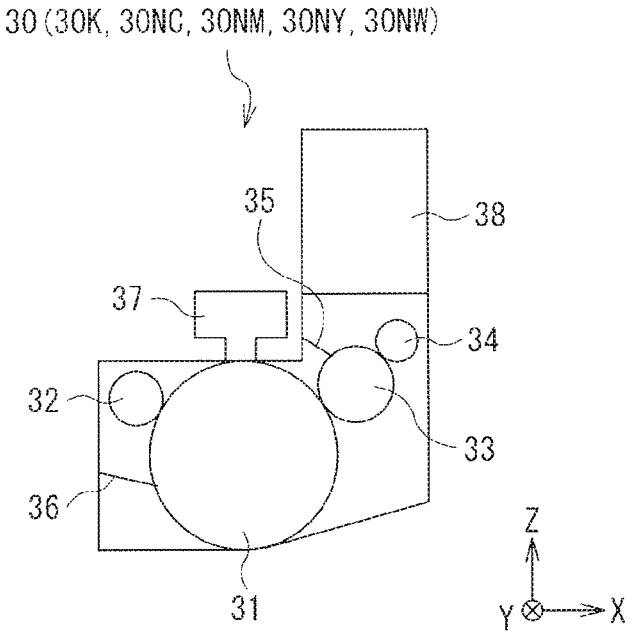
FIG. 2 is an enlarged plan view of an example of a configuration of a developing unit illustrated in FIG. 1.

The configuration of the developing unit 30 is described below. FIG. 2 enlarges the example of the planar configuration of the developing unit 30 illustrated in FIG. 1.

Referring to FIG. 2, the developing units 30K, 30NC, 30NW, 30NY, and 30NW each may include the photosensitive drum 31, a charging roller 32, a developing roller 33, a feeding roller 34, a developing blade 35, a cleaning blade 36, a light-emitting diode (LED) head 37, and the cartridge 38, for example.

[Photosensitive Drum]

The photosensitive drum 31 may be an organic photoreceptor that includes a cylindrical electrically-conductive supporting body and a photoconductive layer, for example. The photoconductive layer may cover an outer peripheral surface of the electrically-conductive supporting body. The photosensitive drum 31 may be rotatable with a drive source such as a motor. The electrically-conductive supporting body may be a metal pipe that includes one or more of metal materials such as aluminum, for example. The photoconductive layer may be a stack that includes an electric charge generating layer and an electric charge transfer layer, for example.

[Charging Roller]

The charging roller 32 may include a metal shaft and an electrically-semiconductive epichlorohydrin rubber layer that covers an outer peripheral surface of the metal shaft, for example. The charging roller 32 may be so pressed against the photosensitive drum 31 as to be in contact with the photosensitive drum 31, thereby charging the photosensitive drum 31.

[Developing Roller]

The developing roller 33 may include a metal shaft and an electrically-semiconductive urethane rubber layer that covers an outer peripheral surface of the metal shaft, for example. The developing roller 33 may support the toner that is fed from the feeding roller 34, and attach the fed toner onto the electrostatic latent image formed on the surface of the photosensitive drum 31.

[Feeding Roller]

The feeding roller 34 may include a metal shaft and an electrically-semiconductive foamed silicone sponge layer that covers an outer peripheral surface of the metal shaft, for example. The feeding roller 34 may feed the luminescent toner to the surface of the photosensitive drum 31 while being in contact with the developing roller 33 in a slidable manner.

[Developing Blade]

The developing blade 35 may control the thickness of the toner fed on the surface of the feeding roller 34. The developing blade 35 may be disposed at a position away from the developing roller 33 with a predetermined spacing in between. The thickness of the toner may be controlled on the basis of the spacing between the developing roller 33 and the developing blade 35. The developing blade 35 may include one or more of metal materials such as stainless steel, for example.

[Cleaning Blade]

The cleaning blade 36 may scrape off unnecessary remains of the toner that are present on the surface of the photosensitive drum 31. The cleaning blade 36 may extend in a direction substantially parallel to a direction in which the photosensitive drum 31 extends, for example. The cleaning blade 36 may be so pressed against the photosensitive drum 31 as to be in contact with the photosensitive drum 31. The cleaning blade 36 may include one or more of polymer materials such as urethane rubber, for example.

[LED Head]

The LED head 37 may be an exposure unit that performs exposure of the surface of the photosensitive drum 31, and thereby forms an electrostatic latent image on the surface of the photosensitive drum 31. The LED head 37 may include an LED device and a lens array, for example. The LED device and the lens array may be so disposed that light (application light) outputted from the LED device is imaged on the surface of the photosensitive drum 31.

[Cartridge]

The cartridge 38 may be attached detachably, for example. The cartridge 38 may contain a toner. The type, specifically, the color, of the toner contained in the cartridge 38 may be as described below, for example.

In this example, the luminescent toner may be a fluorescent toner that generates fluorescent light in response to application of light such as ultraviolet light, for example. Hence, the cartridge 38 of the developing unit 30NC may contain a fluorescent cyan toner that is the luminescent toner, for example. The cartridge 38 of the developing unit 30NM may contain a fluorescent magenta toner that is the luminescent toner, for example. The cartridge 38 of the developing unit 30NY may contain a fluorescent yellow toner that is the luminescent toner, for example. The cartridge 38 of the developing unit 30NW may contain a fluorescent white toner that is the luminescent toner, for example.

The cartridge 38 of the developing unit 30K may contain a black toner that is a non-luminescent toner, for example.

In this example, the luminescent toner may be used to form the luminescent image. Specifically, one or more of the fluorescent cyan toner, the fluorescent magenta toner, the fluorescent yellow toner, and the fluorescent white toner may be used in a case of forming the luminescent image, for example.

It is to be noted that both the luminescent toner and the non-luminescent toner may be used to form the luminescent image. Specifically, the black toner may be used together with the one or more of the fluorescent cyan toner, the fluorescent magenta toner, the fluorescent yellow toner, and the fluorescent white toner in a case of forming the luminescent image, for example.

1-4. Configuration of Toner

The configuration of the toner is described below.

[Types of Toners]

In this example, five types of toners may be used as described above, for example. Specifically, four types of luminescent toners and one type of non-luminescent toner may be used. The four types of luminescent toners may be the fluorescent cyan toner, the fluorescent magenta toner, the fluorescent yellow toner, and the fluorescent white toner. The one type of non-luminescent toner may be the black toner.

The toners described below may be of a single component development method, for example. More specifically, the toners described below may be negatively-charged.

The single component development method provides a toner itself with an appropriate amount of electric charge without using a carrier (a magnetic particle) to apply an electric charge to the toner. In contrast, a two component development method provides a toner with an appropriate amount of electric charge by utilizing friction between the foregoing carrier and the toner owing to mixing of the foregoing carrier and the toner.

[Fluorescent Cyan Toner]

The fluorescent cyan toner may include a cyan coloring agent and a fluorescent whitener, for example. It is to be noted that the fluorescent cyan toner may include one or more other materials together with the cyan coloring agent and the fluorescent whitener.

The cyan coloring agent may include one or more of materials such as a cyan pigment and a cyan dye, for example. Non-limiting examples of the cyan pigment may include phthalocyanine blue such as C.I. Pigment Blue 15:3. Non-limiting examples of the cyan dye may include Pigment Blue 15:3. The content of the cyan coloring agent is not particularly limited. However, for example, the content of the cyan coloring agent may be about 2 parts by weight to about 25 parts by weight with respect to the content (100 parts by weight) of a binder which will be described later in greater detail. Preferably, the content of the cyan coloring agent may be about 2 parts by weight to about 15 parts by weight with respect to the content of the binder.

The fluorescent whitener may include one or more of materials such as a stilbene-based compound, a coumarin-based compound, and a biphenyl-based compound, for example. The content of the fluorescent whitener is not particularly limited. However, for example, the content of the fluorescent whitener may be about 2 parts by weight to about 25 parts by weight with respect to the content (100 parts by weight) of the binder which will be described later in greater detail. Preferably, the content of the fluorescent whitener may be about 2 parts by weight to about 15 parts by weight with respect to the content of the binder.

The types of the materials other than the cyan coloring agent and the fluorescent whitener are not particularly limited. Non-limiting examples of the materials other than the cyan coloring agent and the fluorescent whitener may include the binder, an external additive, a release agent, and an electric charge control agent.

The binder may mainly bind materials such as the fluorescent cyan coloring agents with each other. The binder may include one or more of polymer compounds such as polyester-based resin, styrene-acrylic-based resin, epoxy-based resin, and styrene-butadiene-based resin.

In particular, the binder may preferably include the polyester-based resin. One reason for this is that the polyester-based resin has high affinity for the medium M such as paper, and the toner including the polyester-based resin as the binder is therefore easily fixed to the medium M. Another reason is that the polyester-based resin has high physical strength even with a relatively-small molecular weight, and the toner including the polyester-based resin as the binder therefore has high durability.

Non-limiting examples of the polyester-based resin may include a reactant (a condensation polymer) of one or more alcohols and one or more carboxylic acids.

The type of the alcohol is not particularly limited. However, in particular, the alcohol may be preferably an alcohol having a valence of two or greater or a derivative thereof, for example. Non-limiting examples of the alcohol having the valence of two or greater may include ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, and glycerin.

The type of the carboxylic acid is not particularly limited. However, in particular, the carboxylic acid may be preferably a carboxylic acid having a valence of two or greater or a derivative thereof, for example. Non-limiting examples of the carboxylic acid having the valence of two or greater may include maleic acid, fumaric acid, phthalic acid, isophthalic acid, terephthalic acid, succinic acid, adipic acid, trimellitic acid, pyromellitic acid, cyclopentane dicarboxylic acid, succinic anhydride, trimellitic anhydride, maleic anhydride, and dodecenylsuccinic anhydride.

The external additive may mainly suppress a phenomenon such as aggregation of the fluorescent cyan toner, and thereby improve fluidity of the fluorescent cyan toner. The external additive may include one or more of inorganic materials and organic materials. Non-limiting examples of the inorganic material may include hydrophobic silica. Non-limiting examples of the organic material may include melamine resin. The content of the external additive is not particularly limited. However, for example, the content of the external additive may be from about 0.01 parts by weight to about 10 parts by weight with respect to the conteent of the binder (100 parts by weight), and may be preferably from about 0.05 parts by weight to about 8 parts by weight with respect to the content of the binder.

The release agent may mainly improve characteristics, of the fluorescent cyan toner, such as fixing characteristics and offset resistance. The release agent may include one or more of waxes such as aliphatic-hydrocarbon-based wax, an oxide of aliphatic-hydrocarbon-based wax, fatty-acid-ester-based wax, and a deoxide of fatty-acid-ester-based wax. The release agent may also be a block copolymer of any of the foregoing series of waxes. The content of the release agent is not particularly limited. For example, the content of the release agent may be from about 0.1 parts by weight to about 20 parts by weight with respect to the content (100 parts by weight) of the binder, and may be preferably from about 0.5 parts by weight to about 12 parts by weight with respect to the content of the binder.

Non-limiting examples of the aliphatic-hydrocarbon-based wax may include low-molecular polyethylene, low-molecular polypropylene, a copolymer of olefin, microcrystalline wax, paraffin wax, and Fischer-Tropsch wax. Non-limiting examples of the oxide of aliphatic-hydrocarbon-based wax may include oxidized polyethylene wax. Non-limiting examples of the fatty-acid-ester-based wax may include carnauba wax and montanic acid ester wax. The deoxide of fatty-acid-ester-based wax may be partially-deoxidized or fully-deoxidized fatty-acid-ester-based wax. Non-limiting examples of the deoxide of fatty-acid-ester-based wax may include deoxidized carnauba wax.

The electric charge control agent may mainly control characteristics such as triboelectric charging characteristics of the fluorescent cyan toner. The electric charge control agent to be used for the negatively-charged toner may include one or more of materials such as an azo-based complex, a salicylic-acid-based complex, and a calixarene-based complex, for example. The content of the electric charge control agent is not particularly limited. However, the content of the electric charge control agent may be from about 0.05 parts by weight from about 15 parts by weight with respect to the content (100 parts by weight) of the binder, for example.

[Fluorescent Magenta Toner]

The fluorescent magenta toner may have a configuration almost similar to the configuration of the fluorescent cyan toner except that the fluorescent magenta toner includes one or both of a magenta coloring agent and a fluorescent magenta coloring agent instead of the cyan coloring agent, for example.

The magenta coloring agent may include one or more of materials such as a magenta pigment and a magenta dye, for example. Non-limiting examples of the magenta pigment may include quinacridone. Non-limiting examples of the magenta dye may include C.I. Pigment Red 238.

The fluorescent magenta coloring agent that is the fluorescent coloring agent may include one or more of materials such as a fluorescent magenta pigment and a fluorescent magenta dye. Non-limiting examples of the fluorescent magenta coloring agent may include a fluorescent coloring agent such as SX-100 series and SX-1000 series available from Sinloihi Co., Ltd, located in Kanagawa, Japan.

When the fluorescent magenta toner includes the fluorescent magenta coloring agent, fluorescent characteristics are exhibited by the included fluorescent magenta coloring agent. The fluorescent magenta toner may therefore not necessarily include the fluorescent whitener. In contrast, when the fluorescent magenta toner includes the magenta coloring agent, the fluorescent magenta toner may so include the fluorescent whitener as to secure the fluorescent characteristics.

[Fluorescent Yellow Toner]

The fluorescent yellow toner may have a configuration almost similar to the configuration of the fluorescent cyan toner except that the fluorescent yellow toner includes one or both of a yellow coloring agent and a fluorescent yellow coloring agent instead of the cyan coloring agent, for example.

The yellow coloring agent may include one or more of materials such as a yellow pigment and a yellow dye. Non-limiting examples of the yellow pigment may include Pigment Yellow 74. Non-limiting examples of the yellow dye may include C.I. Pigment Yellow 74 and cadmium yellow.

The fluorescent yellow coloring agent that is the fluorescent coloring agent may include one or more of materials such as a fluorescent yellow pigment and a fluorescent yellow dye, for example. Non-limiting examples of the fluorescent yellow coloring agent may include a fluorescent coloring agent such as SX-100 series and SX-1000 series available from Sinloihi Co., Ltd, Located in Kanagawa, Japan.

When the fluorescent yellow toner includes the fluorescent yellow coloring agent, fluorescent characteristics are exhibited by the included fluorescent yellow coloring agent. The fluorescent yellow toner may therefore not necessarily include the fluorescent whitener. In contrast, when the fluorescent yellow toner includes the yellow coloring agent, the fluorescent yellow toner may so include the fluorescent whitener as to secure the fluorescent characteristics.

[Fluorescent White Toner]

The fluorescent white toner may have a configuration similar to the configuration of the fluorescent cyan toner except that the fluorescent white toner includes a white coloring agent instead of the cyan coloring agent, for example.

The white coloring agent may include one or more of materials such as a white pigment, for example. Non-limiting examples of the white pigment may include titanium oxide.

[Black Toner]

The black toner may have a configuration similar to the configuration of the fluorescent cyan toner except that the black toner includes a black coloring agent instead of the cyan coloring agent and does not include the fluorescent whitener, for example.

The black coloring agent may include one or more of materials such as a black pigment and a black dye, for example. Non-limiting examples of the black pigment may include carbon. Non-limiting examples of the black dye may include carbon black. Non-limiting examples of the carbon black may include furnace black and channel black.

It is to be noted that a method of manufacturing the toners is not particularly limited. The method of manufacturing the toners may be pulverization, polymerization, or any other method, for example. In addition, the foregoing methods may be used in any combination. Non-limiting examples of the polymerization may include suspension polymerization.

1-5. Operation

An example of an operation of the image forming apparatus is described below.

Figure 3:
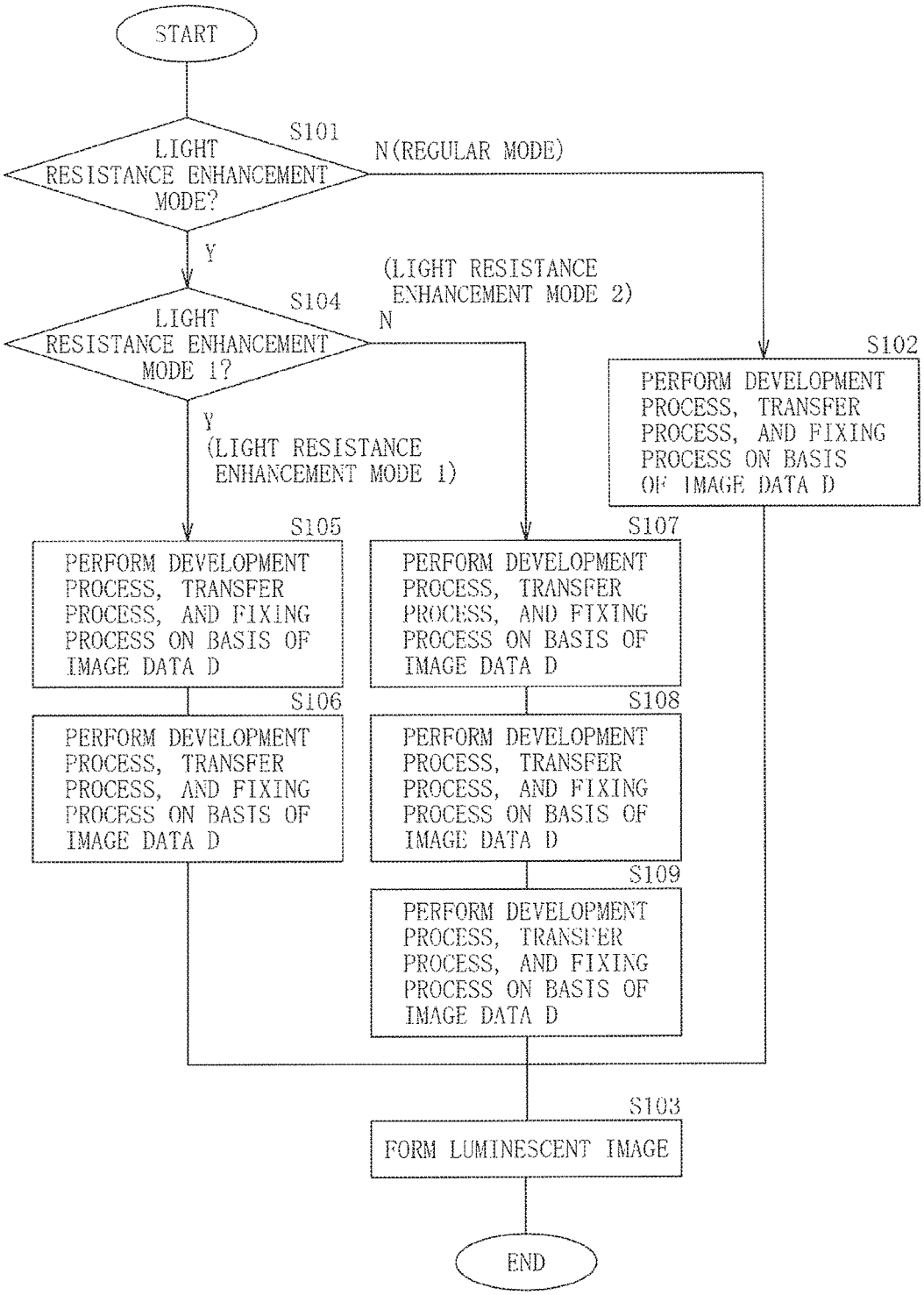
FIG. 3 is a flowchart for describing an example of an operation of the image forming apparatus according to the example embodiment of the technology.
Figure 4:
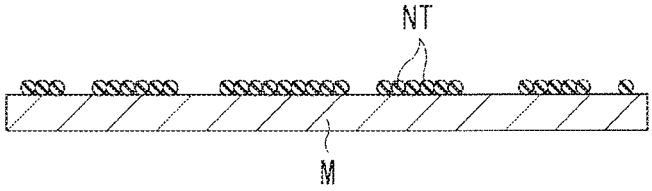
FIG. 4 is a cross-sectional view for describing an example of a configuration of an image that is to be formed by the image forming apparatus according to the example embodiment of the technology.
Figure 5:
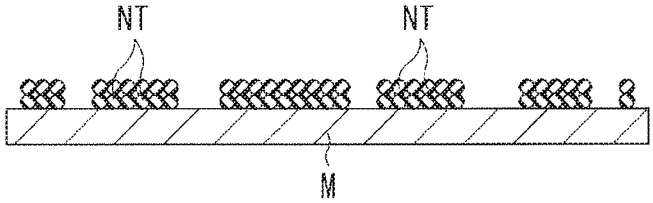
FIG. 5 is a cross-sectional view for describing an example of a configuration of another image that is to be formed by the image forming apparatus according to the example embodiment of the technology.
Figure 6:
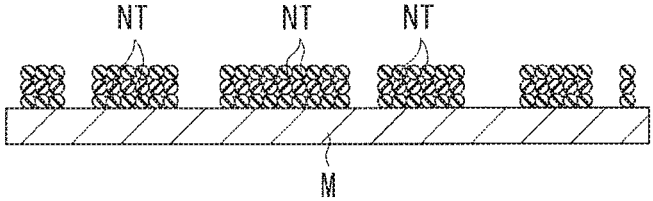
FIG. 6 is a cross-sectional view for describing an example of a configuration of still another image that is to be formed by the image forming apparatus according to the example embodiment of the technology.

FIG. 3 illustrates an example of a flow for describing an operation of the image forming apparatus. FIGS. 4 to 6 each illustrate an example of a cross-sectional configuration of the medium M for describing a configuration of an image to be formed by the image forming apparatus.

A description is given below referring to an example case in which the image forming apparatus performs the image forming operation in the regular mode or the light resistance enhancement mode, and the light resistance enhancement mode involves two modes having respective levels that are different from each other, i.e., a light resistance enhancement mode 1 and a light resistance enhancement mode 2. The number of step in parentheses in the description below corresponds to the number of step illustrated in FIG. 3.

[Selection of Mode]

Before formation of an image, a user may select whether to use the light resistance enhancement mode as the image formation mode by operating the operation panel provided on the image forming apparatus, for example (step S101).

[Formation of Luminescent Image in Regular Mode]

When the user does not select the light resistance enhancement mode (step S101: N), the image forming apparatus may perform an image forming operation in the regular mode on the basis of the image data D (step S102), and thereby form the luminescent image (step S103). The image data D may be directed to the formation of the luminescent image by the image forming apparatus. The image data D may be supplied to the image forming apparatus, for example, from an external terminal device. Non-limiting examples of the external terminal device may include a personal computer that is usable by the user of the image forming apparatus.

Specifically, for example, the image forming apparatus may perform the image forming process once with the use of the luminescent toner on the basis of the image data D, and perform a cleaning process on an as-necessary basis, as will be described below. The image forming process may include the development process, the primary transfer process, the secondary transfer process, and the fixing process.

[Development Process]

The medium M contained in the tray 10 may be picked up by the feeding roller 20. The medium M picked up by the feeding roller 20 may be conveyed by the conveying rollers 61 and 62 along the conveyance route R1 in a direction indicated by an arrow F1.

The development process may involve the operation performed in the developing unit 30NC as described below. In the developing unit 30NC, the charging roller 32 may apply a direct-current voltage to the surface of the photosensitive drum 31 while rotating in accordance with the rotation of the photosensitive drum 31. The surface of the photosensitive drum 31 may be thereby charged evenly.

Thereafter, the LED head 37 may apply light to the surface of the photosensitive drum 31 on the basis of the image data D. A surface potential in a part, of the surface of the photosensitive drum 31, on which the light is applied is thereby attenuated. In other words, optical attenuation occurs in the part, of the surface of the photosensitive drum 31, on which the light is applied. An electrostatic latent image may be thus formed on the surface of the photosensitive drum 31.

In the developing unit 30NC, a luminescent toner NT, specifically, the fluorescent cyan toner, contained in the cartridge 38 may be released toward the feeding roller 34.

The feeding roller 34 may rotate after receiving application of a voltage. The fluorescent cyan toner may be thus fed from the cartridge 38 onto the surface of the feeding roller 34.

The developing roller 33 may rotate while being so pressed against the feeding roller 34 as to be in contact with the feeding roller 34, after receiving application of a voltage. The fluorescent cyan toner fed onto the surface of the feeding roller 34 may be thereby adsorbed onto the surface of the developing roller 33, whereby the fluorescent cyan toner may be conveyed by utilizing the rotation of the developing roller 33. In this case, the fluorescent cyan toner adsorbed onto the surface of the developing roller 33 may be partially removed by the developing blade 35, whereby the fluorescent cyan toner adsorbed onto the surface of the developing roller 33 may be caused to have an even thickness.

After the photosensitive drum 31 rotates while being so pressed against the developing roller 33 as to be in contact with the developing roller 33, the fluorescent cyan toner adsorbed onto the surface of the developing roller 33 may be transferred onto the surface of the photosensitive drum 31. The fluorescent cyan toner may be thereby attached to the surface of the photosensitive drum 31, i.e., the electrostatic latent image.

[Primary Transfer Process]

In the transferring unit 40, when the driving roller 42 rotates, the driven roller 43 and the backup roller 44 may rotate in response to the rotation of the driving roller 42. This may cause the intermediate transfer belt 41 to travel in a direction indicated by an arrow F5.

The primary transfer process may involve application of a voltage to the primary transfer roller 45NC. The primary transfer roller 45NC may be so pressed against the photosensitive drum 31 as to be in contact with the photosensitive drum 31 with the intermediate transfer belt 41 in between. Hence, the fluorescent cyan toner that has been attached to the surface, i.e., the electrostatic latent image of the photosensitive drum 31 in the foregoing development process may be transferred onto the intermediate transfer belt 41.

Thereafter, the intermediate transfer belt 41 onto which the fluorescent cyan toner has been transferred may continue to travel in the direction indicated by the arrow F5. This may allow each of the set of the developing unit 30NM and the primary transfer roller 45NM, the set of the developing unit 30NY and the primary transfer roller 45NY, and the set of the developing unit 30NW and the primary transfer roller 45W to perform the development process and the primary transfer process in order by a procedure similar to the foregoing procedure performed by the developing unit 30NC and the primary transfer roller 45NC.

Specifically, the developing unit 30NM and the primary transfer roller 45NM may transfer the fluorescent magenta toner onto the surface of the intermediate transfer belt 41. Thereafter, the developing unit 30NY and the primary transfer roller 45NY may transfer the fluorescent yellow toner onto the surface of the intermediate transfer belt 41. Thereafter, the developing unit 30NW and the primary transfer roller 45NW may transfer the fluorescent white toner onto the surface of the intermediate transfer belt 41.

It is to be noted that whether each of the development process and the primary transfer process is actually performed by the respective developing units 30NC, 30NM, 30NY, and 30NW and the primary transfer rollers 45NC, 45NM, 45NY, and 45NW may be determined depending on the color or the combination of colors that is necessary for forming the luminescent image.

[Secondary Transfer Process]

The medium M may pass between the backup roller 44 and the secondary transfer roller 46 upon being conveyed along the conveyance route R1.

The secondary transfer process may involve application of a voltage to the secondary transfer roller 46. The secondary transfer roller 46 may be so pressed against the backup roller 44 as to be in contact with the backup roller 44 with the medium M in between. Hence, the luminescent toner NT that has been transferred onto the intermediate transfer belt 41 in the foregoing primary transfer process may be transferred onto the medium M.

[Fixing Process]

After the luminescent toner NT has been transferred onto the medium M in the secondary transfer process, the medium M may be continuously conveyed along the conveyance route R1 in the direction indicated by the arrow F1. The medium M may be thus conveyed to the fixing unit 50.

The fixing process may involve a control that is so performed as to cause the surface temperature of the heating roller 51 to be a predetermined temperature. When the pressurizing roller 52 rotates while being so pressed against the heating roller 51 as to be in contact with the heating roller 51, the medium M may be so conveyed as to pass between the heating roller 51 and the pressurizing roller 52.

The luminescent toner NT that has been transferred onto the surface of the medium M may be thereby applied with heat, which may cause the luminescent toner NT to be molten. Further, the molten luminescent toner NT may be so pressed against the medium M as to be in contact with the medium M. This may allow the luminescent toner NT to be firmly attached to the medium M.

As a result, the luminescent toner NT may be so fixed to a specific region on the surface of the medium M as to have a specific pattern on the basis of the image data D as illustrated in FIG. 4. The luminescent image may be thus formed.

The medium M on which the luminescent image has been formed may be conveyed by the conveying rollers 63 and 64 along the conveyance route R2 in a direction indicated by an arrow F2. The medium M may thus be discharged from the discharge opening 1H to the stacker 2.

It is to be noted that the procedure of conveying the medium M may be varied in accordance with the manner by which the luminescent image is to be formed on the surface of the medium M.

For example, in a case where the luminescent images are to be formed on both surfaces of the medium M, the medium M that has passed the fixing unit 50 may be conveyed by the conveying rollers 65 to 68 along the conveyance routes R3 to R5 in directions indicated by respective arrows F3 and F4, and be thereafter conveyed again by the conveying rollers 61 and 62 along the conveyance route R1 in the direction indicated by the arrow F1. In this case, the direction in which the medium M is to be conveyed may be controlled by the conveyance path switching guides 71 and 72. This may allow the back surface of the medium M to be subjected to the image forming process including the development process, the primary transfer process, the secondary transfer process, and the fixing process. The back surface of the medium M is a surface, of the medium M, on which an image is not yet formed.

[Cleaning Process]

Unnecessary remains of the luminescent toner NT may sometimes be present on the surface of the photosensitive drum 31 in each of the developing units 30NC, 30NM, 30NY, and 30NW. The unnecessary remains of the luminescent toner NT may be part of the luminescent toner NT that has been used in the primary transfer process, which may be the luminescent toner NT that has remained on the surface of the photosensitive drum 31 without being transferred onto the intermediate transfer belt 41, for example.

To address this, the photosensitive drum 31 may rotate while being so pressed against the cleaning blade 36 as to be in contact with the cleaning blade 36 in each of the developing units 30NC, 30NM, 30NY, and 30NW. This may cause the remains of the luminescent toner NT present on the surface of the photosensitive drum 31 to be scraped off by the cleaning blade 36. As a result, the unnecessary remains of the luminescent toner NT may be removed from the surface of the photosensitive drum 31.

Further, in the transferring unit 40, part of the luminescent toner NT that has been transferred onto the surface of the intermediate transfer belt 41 in the primary transfer process may sometimes not be transferred onto the surface of the medium M in the secondary transfer process and may remain on the surface of the intermediate transfer belt 41.

To address this, the cleaning blade 47 may scrape off the remains of the luminescent toner NT present on the surface of the intermediate transfer belt 41 in the transferring unit 40 upon traveling of the intermediate transfer belt 41 in the direction indicated by the arrow F5. As a result, unnecessary remains of the luminescent toner NT may be removed from the surface of the intermediate transfer belt 41.

The image forming operation of the image forming apparatus may be thus completed in the case in which the regular mode is selected by the user.

[Selection of Light Resistance Enhancement Mode 1 or 2]

In contrast, when the user selects the light resistance enhancement mode (step S101: Y), the user may further select whether to use the light resistance enhancement mode 1, for example, by further operating the operation panel (step S104).

In this example, the user may be able to select one of the two light resistance enhancement modes having respective levels that are different from each other, i.e., the light resistance enhancement modes 1 and 2 as described above. The light resistance enhancement mode 1 may be an image formation mode that achieves light resistance greater than that in the regular mode. The light resistance enhancement mode 2 may be an image formation mode that achieves light resistance greater than that in the light resistance enhancement mode 1.

[Formation of Luminescent Image in Light Resistance Enhancement Mode 1]

When the user selects the light resistance enhancement mode 1 (step S104: Y), the image forming apparatus may perform an image forming operation in the light resistance enhancement mode 1 on the basis of the image data D (steps S105 and S106), and thereby form the luminescent image (step S103).

Specifically, for example, the image forming apparatus may perform the image forming process twice, and perform the cleaning process on an as-necessary basis, as will be described below in greater detail. The image forming process for one time may involve a series of processes including the development process, the primary transfer process, the secondary transfer process, and the fixing process, for example.

Specifically, the image forming apparatus may first perform the image forming process for the first time by performing the development process, the primary transfer process, the secondary transfer process, and the fixing process, on the basis of the image data D. This may allow a first layer of the luminescent toner NT to be so fixed to a specific region on the surface of the medium M as to have a specific pattern on the basis of the image data D as illustrated in FIG. 5.

Thereafter, the image forming apparatus may perform the image forming process for the second time by performing again the development process, the primary transfer process, the secondary transfer process, and the fixing process, on the basis of the image data D. This may allow a second layer of the luminescent toner NT to be so fixed to the specific region on the surface of the medium M as to have the specific pattern on the basis of the image data D as illustrated in FIG. 5.

It is to be noted that the content of the image forming process, including the development process, the primary transfer process, the secondary transfer process, the fixing process, and the cleaning process, that is performed twice in the light resistance enhancement mode 1 may be similar to or the same as the content of the image forming process, including the development process, the primary transfer process, the secondary transfer process, the fixing process, and the cleaning process, that is performed in the foregoing regular mode.

As a result, two layers of the luminescent toner NT may be fixed to the medium M, and the luminescent image may be thereby formed.

In this case, each of the first layer of the luminescent toner NT and the second layer of the luminescent toner NT may be fixed to the medium M on the basis of the image data D. This may allow the surface of the medium M to be provided with the second layer of the luminescent toner NT, having the pattern same as the pattern of the first layer of the luminescent toner NT, that is fixed to a region same as the region in which the first layer of the luminescent toner NT has been already fixed to. The second layer of the luminescent toner NT may be thus so disposed as to almost overlap the first layer of the luminescent toner NT. Accordingly, the first layer of the luminescent toner NT and the second layer of the luminescent toner NT may almost overlap each other. Therefore, the luminescent image formed with the first layer of the luminescent toner NT and the luminescent image formed with the second layer of the luminescent toner NT may almost overlap each other. In other words, two luminescent images having the same pattern may be formed in the same region on the medium M, whereby the two luminescent images may be caused to overlap each other.

The foregoing wordings "two luminescent images are formed in the same region" may refer to that the two luminescent images are formed on the basis of the same image data D. Accordingly, as long as the two luminescent images are formed on the basis of the same image data D, the region in which one of the luminescent images is formed and the region in which the other of the luminescent images is formed are not necessarily the same in a precise sense, and may be slightly shifted from each other due to any reason.

In the example case where the image forming process is performed twice for forming the luminescent image in the light resistance enhancement mode 1, the medium M that has passed the fixing unit 50 may be conveyed by the conveying rollers 65 to 67 along the conveyance routes R3 and R5 in the directions indicated by the arrows F3 and F4, and be thereafter conveyed by the conveying rollers 61 and 62 along the conveyance route R1 again in the direction indicated by the arrow F1. In this case, the direction in which the medium M is to be conveyed may be controlled by the conveyance path switching guides 71 and 72. This allows the single surface of the medium M to be repeatedly subjected to the foregoing image forming process.

[Formation of Luminescent Image in Light Resistance Enhancement Mode 2]

In contrast, when the user does not select the light resistance enhancement mode 1 (step S104: N), the image forming apparatus may perform an image forming operation in the light resistance enhancement mode 2 on the basis of the image data D (steps S107, S108, and S109), and thereby form the luminescent image (step S103).

Specifically, for example, the image forming apparatus may perform the image forming process three times, and perform the cleaning process on an as-necessary basis, as will be described below. The image forming process for one time may involve a series of processes including the development process, the primary transfer process, the secondary transfer process, and the fixing process, for example.

Specifically, the image forming apparatus may first perform the image forming process for the first time by performing the development process, the primary transfer process, the secondary transfer process, and the fixing process, on the basis of the image data D. This may allow a first layer of the luminescent toner NT to be so fixed to a specific region on the surface of the medium M as to have a specific pattern on the basis of the image data D as illustrated in FIG. 6.

Thereafter, the image forming apparatus may perform the image forming process for the second time by performing again the development process, the primary transfer process, the secondary transfer process, and the fixing process, on the basis of the image data D. This may allow a second layer of the luminescent toner NT to be so fixed to the specific region on the surface of the medium M as to have the specific pattern on the basis of the image data D as illustrated in FIG. 6.

Lastly, the image forming apparatus may perform the image forming process for the third time by further performing the development process, the primary transfer process, the secondary transfer process, and the fixing process again on the basis of the image data D. This may allow a third layer of the luminescent toner NT to be so fixed to the specific region on the surface of the medium M as to have the specific pattern on the basis of the image data D as illustrated in FIG. 6.

It is to be noted that the content of the image forming process, including the development process, the primary transfer process, the secondary transfer process, the fixing process, and the cleaning process, that is performed three times in the light resistance enhancement mode 2 may be similar to or the same as the content of the image forming process, including the development process, the primary transfer process, the secondary transfer process, the fixing process, and the cleaning process, that is performed in the foregoing regular mode.

As a result, three layers of the luminescent toner NT may be fixed to the medium M, and the luminescent image may be thereby formed.

In this case, each of the first layer of the luminescent toner NT, the second layer of the luminescent toner NT, and the third layer of the luminescent toner NT may be fixed to the medium M on the basis of the image data D. This may allow the surface of the medium M to be provided with the second layer of the luminescent toner NT, having the pattern same as the pattern of the first layer of the luminescent toner NT, that is fixed to a region same as the region in which the first layer of the luminescent toner NT has been already fixed to. The second layer of the luminescent toner NT may be thus so disposed as to almost overlap the first layer of the luminescent toner NT. Further, this allows the surface of the medium M to be provided with the third layer of the luminescent toner NT, having the pattern same as the pattern of the first and second layers of the luminescent toner NT, that is fixed to a region same as the region in which the first and second layers of the luminescent toner NT have been already fixed to. The third layer of the luminescent toner NT may be thus so disposed as to almost overlap the first and second layers of the luminescent toner NT. Accordingly, the first layer of the luminescent toner NT, the second layer of the luminescent toner NT, and the third layer of the luminescent toner NT may almost overlap each other. Therefore, the luminescent image formed with the first layer of the luminescent toner NT, the luminescent image formed with the second layer of the luminescent toner NT, and the luminescent image formed with the third layer of the luminescent toner NT may almost overlap each other. In other words, three luminescent images having the same pattern may be formed in the same region on the medium M, whereby the three luminescent images may be caused to overlap each other.

The foregoing wordings "three luminescent images are formed in the same region" may refer to that the three luminescent images are formed on the basis of the same image data D. Accordingly, as long as the three luminescent images are formed on the basis of the same image data D, the region in which the first one of the luminescent images is formed, the region in which the second one of the luminescent images is formed, and the region in which the third one of the luminescent images is formed are not necessarily the same in a precise sense, and may be slightly shifted from each other due to any reason.

In the example case where the image forming process is performed three times for forming the luminescent image in the light resistance enhancement mode 2, the medium M that has passed the fixing unit 50 may be conveyed by the conveying rollers 65 to 67 along the conveyance routes R3 and R5 in the directions indicated by the arrows F3 and F4, and be thereafter conveyed by the conveying rollers 61 and 62 along the conveyance route R1 again in the direction indicated by the arrow F1, in a manner similar to or the same as the manner in which the luminescent images are formed in the foregoing light resistance enhancement mode 1.

1-6. Example Workings and Example Effects

The image forming apparatus may perform, for the medium M, the image forming process plural times on the basis of the image data D, and thereby form the luminescent image on the surface of the medium M. The image forming process may include the development process, the primary transfer process, the secondary transfer process, and the fixing process. It is therefore possible to achieve a high-quality luminescent image for the following reasons.

Referring to FIG. 4, the user is able to achieve a desired luminescent image having luminescent characteristics also in a case where the image forming process is performed only once for the medium M on the basis of the image data D.

However, while the luminescent toner NT is able to exhibit, for example, a favorable feature by the use of the luminescent characteristics as its characteristics, the color of the luminescent toner NT may fade easily. When the image forming process is performed only once, the absolute amount of the luminescent toner NT to be used to form the luminescent image, i.e., the amount of the luminescent toner NT to be fixed to the medium M may be small. In this case, due to the fact that the color of the luminescent toner NT fades easily, when the color of the luminescent toner NT fades, the fading of the color of the luminescent toner NT may easily influence the quality of the luminescent image. Specifically, the fading of the color of the luminescent toner NT may lead to a decrease in color optical density and blurred outline, thereby making it easier to cause degradation of quality of the luminescent image.

Accordingly, it may be difficult to achieve a high-quality luminescent image in terms of quality retention of the luminescent image.

In contrast, when the image forming process is performed for the medium M plural times on the basis of the image data D as illustrated in FIG. 5, it is possible for the user to obtain the desired luminescent image having luminescent characteristics.

In addition thereto, when the image forming process is performed plural times, the absolute amount of the luminescent toner NT to be used for forming the luminescent image, i.e., the amount of the fixed luminescent toner NT, may increase. In this case, even the color of the luminescent toner NT fades, the fading of the color of the luminescent toner NT may be less likely to influence the quality of the luminescent image. This makes the quality of the luminescent image less likely to be degraded.

In particular, the plurality of layers of the luminescent toner NT may be fixed to the medium M on the basis of the same image data D. Accordingly, the regions to which the respective layers of the luminescent toner NT are fixed may almost overlap each other on the surface of the medium M. In this case, the shift in color due to the shift in position between the layers of the luminescent toner NT is sufficiently suppressed. This suppresses degradation of quality of the luminescent image due to the shift in color.

It is therefore possible to achieve a high-quality luminescent image in terms of quality retention of the luminescent image.

The foregoing image forming apparatus may achieve the following advantages in addition to the advantages described above.

One advantage is the following. The fixing unit 50 may perform the fixing process of the luminescent toner NT plural times as separate processes, and thereby form the luminescent image. Specifically, in an example case where the fixing process of the luminescent toner NT is performed twice, the image forming process with the use of the luminescent toner NT including the development process, the primary transfer process, the secondary transfer process, and the fixing process may be performed for the first time, and thereafter, the image forming process with the use of the luminescent toner NT may be performed again for the second time.

In the foregoing example case, the fixing process of the luminescent toner NT for the first time may be already completed before performing the image forming process for the second time. The luminescent toner NT subjected to the fixing process for the first time may be therefore firmly attached to the medium M already before performing the image forming process for the second time. Accordingly, the luminescent toner NT used for the first time is less likely to adversely influence the quality of the image, compared with a case where the fixing process of the luminescent toner NT for the first time is not yet completed before performing the image forming process for the second time.

More in detail, in a state where the fixing process of the luminescent toner NT for the first time is not yet completed, the luminescent toner NT is not firmly attached to the medium M. The luminescent toner NT may be therefore easily removed from the medium M. The luminescent toner NT may be also easily moved from a position at which the luminescent toner NT is to be fixed to another position on the medium M. This may possibly decrease the color optical density of the luminescent image and blur the outline of the luminescent image. In contrast, in a state where the fixing process of the luminescent toner NT for the first time is already completed, the luminescent toner NT may be firmly attached to the medium M. This may make it more difficult for the luminescent toner NT to be removed from the medium M. This may also make it more difficult for the luminescent toner NT to be moved from the position at which the luminescent toner NT is to be fixed to another position on the medium M. Accordingly, it is less likely for the color optical density of the luminescent image to be decreased and is less likely for the outline of the luminescent image to be blurred. As a result, it is less likely for the quality of the luminescent image to be degraded.

As described above, by causing the fixing unit 50 to perform the fixing process of the luminescent toner NT plural times as separate processes, the quality of the luminescent image is further improved, thereby achieving a higher effect.

Another advantage is that, when the luminescent toner includes one or both of the fluorescent coloring agent and the fluorescent whitener, it is possible to form a high-quality fluorescent image by utilizing luminescent characteristics of the luminescent toner to be used.

2. MODIFICATION EXAMPLES

The configuration of the image forming apparatus may be modifiable in an appropriate manner as described below.

Modification Example 1

Specifically, the fixing unit 50 may perform the fixing process of the luminescent toner NT plural times as separate processes, and thereby form the luminescent image. More specifically, in an example case where the fixing process of the luminescent toner NT is performed twice, the image forming process with the use of the luminescent toner NT including the development process, the primary transfer process, the secondary transfer process, and the fixing process may be performed for the first time, and thereafter, the image forming process with the use of the luminescent toner NT may be performed again for the second time.

However, for example, the fixing unit 50 may perform the fixing process of the luminescent toner NT plural time as a single process as long as the two layers of the luminescent toner NT are allowed to be fixed to the medium M.

In this case, for example, the development process and the primary transfer process with the use of the luminescent toner NT may be performed, and the development process and the primary transfer process with the use of the luminescent toner NT may be performed continuously. Thereafter, the secondary transfer process and the fixing process with the use of the foregoing luminescent toner NT may be performed. In this case, after the first layer of the luminescent toner NT is transferred onto the surface of the intermediate transfer belt 41, the second layer of the luminescent toner NT may be transferred onto the first layer of the luminescent toner NT. The two layers of the luminescent toner NT may thus overlap each other on the intermediate transfer belt 41. The two layers of the luminescent toner NT may be thereby fixed to the medium M collectively in the fixing process performed by the fixing unit 50 as a single process.

Alternatively, for example, the development process, the primary transfer process, and the secondary transfer process may be performed with the use of the luminescent toner NT, and the development process, the primary transfer process, and the secondary transfer process may be performed again continuously with the use of the luminescent toner NT. Thereafter, the fixing process may be performed with the use of the luminescent toner NT used in the two sets of the development process, the primary transfer process, and the secondary process. In this case, after the first layer of the luminescent toner NT is transferred onto the surface of the medium M, the second layer of the luminescent toner NT may be transferred onto the first layer of the luminescent toner NT. The two layers of the luminescent toner NT may thus overlap each other on the medium M. The two layers of the luminescent toner NT may be thereby fixed to the medium M collectively in the fixing process performed by the fixing unit 50 as a single process.

Also in the foregoing cases, by performing the fixing processes of the luminescent toner NT plural times on the basis of the image data D, the plurality of layers of the luminescent toner NT may overlap each other on the medium M. It is therefore possible to achieve a high-quality luminescent image.

However, the luminescent toner NT that is not yet fixed to the medium M may tend to be easily removed from the medium M or be easily moved on the medium M as described above. It may be therefore more preferable to perform the fixing process plural times. Accordingly, it may be preferable to cause the fixing unit 50 to perform the fixing process of the luminescent toner NT plural times as separate processes, in order to improve image quality.

Modification Example 2

The luminescent image including two or three layers of the luminescent toner NT may be formed as illustrated in FIGS. 5 and 6 by performing the image forming process for the medium M twice or three times on the basis of the image data D.

However, for example, the number of the image forming process to be performed is not particularly limited as long as the image forming process is performed twice or more. For example, the image forming process may be performed four times, five times, or more. As the number of the image forming process to be performed increases, the absolute amount of the luminescent toner NT to be used for forming the luminescent image increases, which makes it more difficult for the quality of the luminescent image to be degraded. It is therefore possible to further improve the quality of the luminescent image.

Modification Example 3

The five types of toners, i.e., the black toner, the fluorescent cyan toner, the fluorescent magenta toner, the fluorescent yellow toner, and the fluorescent white toner, may be used. However, the types of the toners, i.e., the combination of the colors of the toners, may be varied optionally. Specifically, for example, the fluorescent white toner may not be used and the fluorescent cyan toner, the fluorescent magenta toner, and the fluorescent yellow toner may be used as the luminescent toners. Alternatively, for example, only the luminescent toners, i.e., the fluorescent cyan toner, the fluorescent magenta toner, the fluorescent yellow toner, and the fluorescent white toner, may be used and the non-luminescent toner, i.e., the black toner may not be used.

Also in the modification example 3, it is possible to achieve a high-quality luminescent image by performing the image forming process for the medium M plural times on the basis of the image data D.

Modification Example 4

In a case where the plurality of luminescent images are so formed as to overlap each other with the plurality of layers of the luminescent toner NT, the configuration of the luminescent images may be set optionally. Specifically, the configurations of the respective luminescent images may be the same as each other, or may be different from each other. It is to be noted that the configurations of some of the luminescent images may be the same as each other.

Specifically, for example, the thickness of each of the luminescent images is not particularly limited, and may be set optionally. As an example case, the thicknesses of some of the luminescent images may be set relatively large, and the thicknesses of the others of the luminescent images may be set relatively small. Further, for example, the printing rate of each of the luminescent images is not particularly limited, and may be settable optionally. As an example case, the printing rate of some of the luminescent images may be set relatively high, and the printing rate of the others of the luminescent images may be set relatively low. The printing rate is a so-called duty ratio. Also in the foregoing cases, it is possible to achieve a high-quality luminescent image.

EXAMPLES

Examples of the example embodiment of the technology are described in detail in the following order.

1. Quality of Luminescent Image
2. Improvement in Quality of Luminescent Image

1. LIGHT RESISTANCE OF LUMINESCENT IMAGE

First, in order to examine the quality of the luminescent image formed with the use of the luminescent toners including the fluorescent yellow toner, the fluorescent magenta toner, the fluorescent cyan toner, and the fluorescent white toner for the respective colors, the luminescent images of the respective colors were formed with the use of the respective luminescent toners, and the quality of each of the luminescent images of the respective colors was examined.

Upon forming the luminescent images, a color printer MICROLINE VINCI C941dn having a linear velocity of 200 mm/sec at an outermost circumference of the photosensitive drum available from Oki Data Corporation, located in Tokyo, Japan was used as the image forming apparatus, and color printer sheets Excellent White A4 available from Oki Data Corporation, Tokyo, Japan was used as the media on which the luminescent images were to be formed.

Upon forming the luminescent images under the foregoing conditions, the regular mode described referring to FIG. 3 was used as the image formation mode. The image forming process was performed once in such a manner with the use of each of the fluorescent yellow toner, the fluorescent magenta toner, the fluorescent cyan toner, and the fluorescent white toner, and a solid image of each of the colors was formed thereby. The image forming process included the development process, the primary transfer process, the secondary transfer process, and the fixing process. The solid image refers to an image having a printing rate of 100%. The image formation was performed under an environment condition corresponding to the ambient temperature condition, and a direction of printing of the image corresponded to a longitudinal direction of the medium. The ambient temperature condition refers to a condition having a temperature of 25° C. and humidity of 40%. The area density at the time of fixing of each of the fluorescent yellow toner, the fluorescent magenta toner, the fluorescent cyan toner, and the fluorescent white toner was 0.4 mg/cm$^2$.

Upon examining the quality of the luminescent images, the remaining rate (%) was determined on the basis of the luminescent image of each of the colors, and the change over time in the image quality of the luminescent image of each of the colors was evaluated visually.

Upon determining the remaining rate of the luminescent image formed with the use of the fluorescent yellow toner, first, five luminescent images were formed with the use of the fluorescent yellow toner. Thereafter, the density of each of the five luminescent images was measured by means of a spectrodensitometer, and an average value of the measured values was calculated. 528 spectrodensitometer available from X-Rite Pantone, located in Michigan, USA was used as the spectrodensitometer. Upon measuring the density of the luminescent images, the density at the central position in each of the luminescent images was measured. Thereafter, the density of each of the five luminescent images was measured every three hours while applying test light to each of the five luminescent images by means of a weathering test instrument. Ci4000 Weather-Ometer available from Atlas, located in Illinois, USA was used as the weathering test instrument. The test light was applied at illuminance of 55000 lux for 30 hours. In this case, an average value was calculated of the values of density of the five luminescent images measured every three hours, as when the density before application of the test light was measured. Lastly, the remaining rate was calculated for every three hours on the basis of a calculation equation [remaining rate (%)]=[density after application of test light]/[density before application of test light]×100.

The remaining rate was determined for the luminescent images formed with the use of the fluorescent magenta toner, the luminescent images formed with the use of the fluorescent cyan toner, and the luminescent images formed with the use of the fluorescent white toner by a procedure similar to the procedure of calculating the remaining rate of the luminescent images formed with the use of the fluorescent yellow toner. The following results described in Tables 1 to 4 were obtained thereby.

TABLE 1

| Toner: Fluorescent yellow toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 91.1 | 82.6 | 71.2 | 65.5 | 61.6 | 55.8 | 53.6 | 51.2 | 47.5 | 44.5 |

TABLE 2

| Toner: Fluorescent magenta toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 91.1 | 82.6 | 72.9 | 67.6 | 64 | 58.8 | 57.8 | 55 | 52.5 | 50.8 |

TABLE 3

| Toner: Fluorescent cyan toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 99.9 | 100 | 98.9 | 98.8 | 99.9 | 98 | 100 | 100 | 100 | 100 |

TABLE 4

| Toner: Fluorescent white toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 99.3 | 99.3 | 99.6 | 97.6 | 99 | 99.3 | 97.9 | 99.3 | 98.6 | 99 |

Upon visually evaluating the change over time in the image quality of the luminescent images formed with the use of the fluorescent yellow toner, the image quality of the luminescent images were visually evaluated every three hours while applying the test light to the luminescent images. The image quality was visually evaluated while applying the test light to the luminescent images in a similar manner also for the luminescent images formed with the use of the fluorescent magenta toner, the luminescent images formed with the use of the fluorescent cyan toner, and the luminescent images formed with the use of the fluorescent white toner. The results described in Table 5 were obtained thereby.

Upon the visual evaluation, when the original color at the time of the formation of the luminescent image was sufficiently maintained, and the color of the luminescent image was therefore still easily identified, the image quality was evaluated as "A". When the original color at the time of the formation of the luminescent image faded, and the color of the luminescent image was therefore difficult to be identified, the image quality was evaluated as "C".

TABLE 5

| Mode: Regular mode, Printing rate: 100% | | | | |
|---|---|---|---|---|
| Elapsed time (hour) | Image quality evaluation | | | |
| | Fluorescent yellow | Fluorescent magenta | Fluorescent cyan | Fluorescent white |
| 0 | A | A | A | A |
| 3 | A | A | A | A |
| 6 | A | A | A | A |
| 9 | A | A | A | A |
| 12 | C | C | A | A |
| 15 | C | C | A | A |
| 18 | C | C | A | A |
| 21 | C | C | A | A |
| 24 | C | C | A | A |
| 27 | C | C | A | A |
| 30 | C | C | A | A |

As described in Tables 1 to 4, the light resistance differed largely between the types (the colors) of the luminescent toners when the luminescent images were formed with the luminescent toners in the regular mode.

Specifically, referring to Tables 3 and 4, in the case of using the fluorescent cyan toner and the fluorescent white toner, the color of the luminescent images hardly faded over time. The remaining rates of the luminescent images formed with the use of the fluorescent cyan toner and the fluorescent white toner were nearly 100% even after 30 hours had elapsed. As can be appreciated from this result, each of the fluorescent cyan toner and the fluorescent white toner has a color that is less likely to fade in the first place.

In contrast, referring to Tables 1 and 2, in the case of using the fluorescent yellow toner and the fluorescent magenta toner, the color of the luminescent images faded largely over time. The remaining rates of the luminescent images formed with the use of the fluorescent yellow toner and the fluorescent magenta toner were decreased to about 50% after 30 hours had elapsed. In the case of using the fluorescent yellow toner and the fluorescent magenta toner, in particular, the remaining rate decreased more in the case of using the fluorescent yellow toner than the case of using the fluorescent magenta toner. As can be appreciated from this result, each of the fluorescent yellow toner and the fluorescent magenta toner has a color that fades easily in the first place.

Further, referring to Table 5, the image quality differed largely between the types (the colors) of the luminescent toners when the luminescent images were formed with the use of the luminescent toners in the regular mode.

Specifically, in the case of using the fluorescent cyan toner and the fluorescent white toner, the colors were maintained sufficiently over time. Therefore, favorable image quality was obtained even after 30 hours had elapsed.

In contrast, in the case of using the fluorescent yellow toner and the fluorescent magenta toner, the colors were drastically degraded over time. Therefore, favorable image quality was not obtainable after 9 hours had elapsed.

According to the foregoing results, there is a tendency that the color of the luminescent image is less likely to fade over time and image quality is maintained sufficiently in the case of forming the luminescent image with the use of any of the fluorescent cyan toner and the fluorescent white toner. In contrast, there is a tendency that the color of the luminescent image fades easily over time and image quality is degraded easily in the case of forming the luminescent image with the use of any of the fluorescent yellow toner and the fluorescent magenta toner.

2. IMPROVEMENT IN QUALITY OF LUMINESCENT IMAGE

Next, in order to examine a state of improvement in the quality of the luminescent image, the luminescent images were formed with the use of the luminescent toners in the light resistance enhancement mode, and thereafter, the light resistance and the image quality of the formed luminescent images were examined.

Upon examining the state of improvement in the quality of the luminescent image, the fluorescent yellow toner and the fluorescent magenta toner were used as the luminescent toner, taking into consideration that sufficient light resistance was not obtained in the case of using each of the fluorescent yellow toner and the fluorescent magenta toner in contrast to that the sufficient light resistance was obtained in the case of using the fluorescent cyan toner and the fluorescent white toner.

Upon forming the luminescent image with the use of the fluorescent yellow toner, three types of image formation modes described referring to FIG. 3, i.e., the regular mode, the light resistance enhancement mode 1, and the light resistance enhancement mode 2, were used as the image formation mode.

Upon forming the luminescent image in the regular mode, the image forming process was performed once with the use of the fluorescent yellow toner, and the solid image having the printing rate of 100% was thereby formed. Upon forming the luminescent image in the light resistance enhancement mode 1, the image forming process was repeated twice with the use of the fluorescent yellow toner, and the solid image having the printing rate of 100% was thereby formed. Upon forming the luminescent image in the light resistance enhancement mode 2, the image forming process was repeated three times with the use of the fluorescent yellow toner, and the solid image having the printing rate of 100% was thereby formed. It is to be noted that the model number of the image forming apparatus, the type of the medium, and the details of the environment conditions were the same as those described above.

Upon examining the state of improvement in quality of the luminescent images formed in the light resistance enhancement modes, the remaining rate (%) was determined on the basis of each of the luminescent images formed in the three types of image formation modes, and the change over time in the image quality of each of those luminescent images was visually evaluated. The procedure of calculating the remaining rate and the procedure of evaluating image quality were the same as those described above.

The remaining rate (%) was determined on the basis of the luminescent images formed in the regular mode, and the result described in Table 6 was obtained. Further, the change over time in the image quality of those luminescent images formed in the regular mode was visually evaluated, and the result described in Table 9 was obtained.

The remaining rate (%) was determined on the basis of the luminescent images formed in the light resistance enhancement mode 1, and the result described in Table 7 was obtained. Further, the change over time in the image quality of those luminescent images formed in the light resistance enhancement mode 1 was visually evaluated, and the result described in Table 9 was obtained.

The remaining rate (%) was determined on the basis of the luminescent images formed in the light resistance enhancement mode 2, and the result described in Table 8 was obtained. Further, the change over time in the image quality of those luminescent images formed in the light resistance enhancement mode 2 was visually evaluated, and the result described in Table 9 was obtained.

Further, the luminescent images were formed in a procedure similar to the procedure described above except for using the luminescent magenta toner instead of the luminescent yellow toner. Thereafter, the remaining rate (%) of the formed luminescent images was determined, and the change over time in image quality of the formed luminescent images was visually evaluated. The results described in Tables 10 to 13 were thereby obtained. Specifically, the remaining rate was determined on the basis of the luminescent images formed in the regular mode, and the result described in Table 10 was obtained. The change over time in image quality of those luminescent images formed in the regular mode was also visually evaluated, and the result described in Table 13 was obtained. The remaining rate was determined on the basis of the luminescent images formed in the light resistance enhancement mode 1, and the result described in Table 11 was obtained. The change over time in image quality of those luminescent images formed in the light resistance enhancement mode 1 was also visually evaluated, and the result described in Table 13 was obtained. The remaining rate was determined on the basis of the luminescent images formed in the light resistance enhancement mode 2, and the result described in Table 12 was obtained. The change over time in image quality of those luminescent images formed in the light resistance enhancement mode 2 was also visually evaluated, and the result described in Table 13 was obtained.

TABLE 6

| Toner: Fluorescent yellow toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 91.1 | 82.6 | 71.2 | 65.5 | 61.6 | 55.8 | 53.6 | 51.2 | 47.5 | 44.5 |

TABLE 7

| Toner: Fluorescent yellow toner, Mode: Light resistance enhancement mode 1, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 92.4 | 84.9 | 74.6 | 69 | 65.1 | 59.9 | 57 | 53.8 | 49.2 | 46.5 |

TABLE 8

| Toner: Fluorescent yellow toner, Mode: Light resistance enhancement mode 2, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 94 | 87.9 | 78.8 | 73.4 | 69.6 | 64.3 | 61.4 | 57.8 | 52.5 | 49.8 |

TABLE 9

| Toner: Fluorescent yellow toner | | | |
|---|---|---|---|
| | Image quality evaluation | | |
| Elapsed time (hour) | Regular mode | Light resistance enhancement mode 1 | Light resistance enhancement mode 2 |
| 0 | A | A | A |
| 3 | A | A | A |
| 6 | A | A | A |
| 9 | A | A | A |
| 12 | A | A | A |
| 15 | C | A | A |

TABLE 9-continued

| Toner: Fluorescent yellow toner | | | |
|---|---|---|---|
| | Image quality evaluation | | |
| Elapsed time (hour) | Regular mode | Light resistance enhancement mode 1 | Light resistance enhancement mode 2 |
| 18 | C | A | A |
| 21 | C | A | A |
| 24 | C | A | A |
| 27 | C | A | A |
| 30 | C | C | A |

TABLE 10

| Toner: Fluorescent magenta toner, Mode: Regular mode, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 91.1 | 82.6 | 72.9 | 67.6 | 64 | 58.8 | 57.8 | 55 | 52.5 | 50.8 |

TABLE 11

| Toner: Fluorescent magenta toner, Mode: Light resistance enhancement mode 1, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 92.4 | 84.9 | 76.3 | 71.1 | 67.5 | 62.9 | 61.2 | 57.6 | 54.2 | 51.4 |

TABLE 12

| Toner: Fluorescent magenta toner, Mode: Light resistance enhancement mode 2, Printing rate: 100% | | | | | | | | | | | |
|---|---|---|---|---|---|---|---|---|---|---|---|
| | Elapsed time (hour) | | | | | | | | | | |
| | 0 | 3 | 6 | 9 | 12 | 15 | 18 | 21 | 24 | 27 | 30 |
| Remaining rate (%) | 100 | 95.5 | 90.7 | 82.3 | 77.4 | 74 | 67.9 | 65.1 | 61.4 | 57.5 | 54.2 |

TABLE 13

| Toner: Fluorescent magenta toner | | | |
|---|---|---|---|
| | Image quality evaluation | | |
| Elapsed time (hour) | Regular mode | Light resistance enhancement mode 1 | Light resistance enhancement mode 2 |
| 0 | A | A | A |
| 3 | A | A | A |
| 6 | A | A | A |
| 9 | A | A | A |
| 12 | C | A | A |
| 15 | C | A | A |
| 18 | C | A | A |
| 21 | C | A | A |
| 24 | C | A | A |
| 27 | C | A | A |
| 30 | C | C | A |

In the case of using the fluorescent yellow toner (Tables 6 to 9), the remaining rate was higher when the luminescent images were formed in any of the light resistance enhancement modes 1 and 2 (Tables 7 and 8) than when the luminescent images were formed in the regular mode (Table 6) as can be appreciated from Tables 6 to 8.

Specifically, the remaining rate was higher when the luminescent images were formed in the light resistance enhancement mode 1 (Table 7) than when the luminescent images were formed in the regular mode (Table 6). Further, the remaining rate was still higher when the luminescent images were formed in the light resistance enhancement mode 2 (Table 8) than when the luminescent images were formed in the light resistance enhancement mode 1 (Table 7). As can be appreciated from these results, the color of the luminescent images formed in the light resistance enhancement modes 1 and 2 is less likely to fade than the color of the luminescent images formed in the regular mode.

Further, as can be appreciated from the result described in Table 9, the image quality is less likely to be degraded when the luminescent images were formed in any of the light resistance enhancement modes 1 and 2 than when the luminescent images were formed in the regular mode.

Specifically, when the luminescent images were formed in the regular mode, favorable image quality was obtainable until 12 hours had elapsed; however, favorable image quality was not obtainable after 12 hours had elapsed. In contrast, favorable image quality was obtainable until 27 hours had elapsed when the luminescent images were formed in the light resistance enhancement mode 1. Further, favorable image quality was obtainable even after 30 hours had elapsed when the luminescent images were formed in the light resistance enhancement mode 2. As can be appreciated from these results, the image quality of the luminescent images formed in the light resistance enhancement modes 1 and 2 is less likely to be degraded than the image quality of the luminescent images formed in the regular mode.

In particular, when the luminescent images were formed in the light resistance enhancement mode 1 or 2, degradation of image quality due to a factor such as a color shift was hardly confirmed despite overlapping of two or three layers of the luminescent toner.

According to the results described above, there is a tendency that the color of the luminescent image is likely to fade over time and the image quality of the luminescent image is likely to degraded when the luminescent image is formed in the regular mode. In contrast, there is a tendency that the color of the luminescent image is less likely to fade over time and the image quality of the luminescent image is likely to be maintained sufficiently when the luminescent image is formed in any of the light resistance enhancement modes 1 and 2.

Also in the case of using the fluorescent magenta toner (Tables 10 to 13), there was a tendency similar to the tendency in the case of using the fluorescent yellow toner (Tables 6 to 9). Specifically, referring to Tables 10 to 12, the remaining rate was higher when the luminescent images were formed in any of the light resistance enhancement modes 1 and 2 (Tables 11 and 12) than when the luminescent images were formed in the regular mode (Table 10). Further, as can be appreciated from the result described in Table 13, the image quality is less likely to be degraded when the luminescent images were formed in any of the light resistance enhancement modes 1 and 2 than when the luminescent images were formed in the regular mode.

According to the results described in Tables 1 to 13, the color of the luminescent image was less likely to fade and the image quality of the luminescent image was maintained more easily by performing the image forming process plural times for the same medium on the basis of the same image data. The high-quality luminescent image was therefore obtained. The image forming process included the development process, the primary transfer process, the secondary transfer process, and the fixing process.

Although some preferred example embodiments of the technology have been described in the foregoing by way of example with reference to the accompanying drawings, the technology is by no means limited to the example embodiments described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

Specifically, for example, the image forming scheme of the image forming apparatus according to one embodiment of the technology is not limited to the intermediate transfer scheme with the use of the intermediate transfer belt, and may be any other image forming scheme. Another image forming scheme may be, for example, an image forming scheme not involving the use of the intermediate transfer belt. In the image forming scheme not involving the use of the intermediate transfer belt, the toner attached to the latent image is transferred onto the medium not indirectly with the intermediate transfer belt in between, but the toner attached to the latent image may be directly transferred onto the medium.

Moreover, the image forming apparatus according to one embodiment of the technology is not limited to a printer, and may be an apparatus such as a copier, a facsimile, and a multi-function peripheral.

Furthermore, the technology encompasses any possible combination of some or all of the various embodiments and the modifications described herein and incorporated herein.

It is possible to achieve at least the following configurations from the above-described example embodiments of the technology.

(1)

An image forming apparatus including:

a developing unit that performs an attachment process in which the developing unit attaches a luminescent toner to a latent image that is formed on a basis of image data;

a transferring unit that performs a transfer process in which the transferring unit transfers, onto a medium, the luminescent toner attached to the latent image; and a fixing unit that performs a fixing process in which the fixing unit fixes, to the medium, the luminescent toner transferred onto the medium, in which the attachment process performed by the developing unit and the transfer process performed by the transferring unit are each performed plural times for the medium, on the basis of the image data.

(2)

The image forming apparatus according to (1), in which the attachment process performed by the developing unit and the transfer process performed by the transferring unit are each performed plural times for the same medium, on the basis of the same image data.

(3)

The image forming apparatus according to (1) or (2), in which a plurality of luminescent images are each formed on a basis of the luminescent toner attached, by the developing unit, to the latent image, and the luminescent images are caused to overlap each other on the medium.

(4)

The image forming apparatus according to (3), in which the luminescent images are caused to overlap each other by forming the luminescent images in a same region on the medium.

(5)

The image forming apparatus according to any one of (1) to (4), in which the fixing process performed by the fixing unit is performed plural times.

(6)

The image forming apparatus according to (5), in which the fixing unit performs the fixing process plural times as separate processes.

(7)

The image forming apparatus according to any one of (1) to (6), in which the luminescent toner includes one or both of a fluorescent coloring agent and a fluorescent whitener.

According to the image forming apparatus of one embodiment of the technology, each of the attachment process performed by the developing unit and the transfer process performed by the transferring unit are performed plural times for the medium on the basis of the image data. It is therefore possible to achieve a high-quality luminescent image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

a feeder that feeds a medium;

a developing unit that performs a first attachment process in which the developing unit attaches a luminescent toner to a first latent image that is formed on a basis of image data, to form a first toner image, and performs a second attachment process in which the developing unit attaches the luminescent toner to a second latent image that is formed on the basis of the image data, to form a second toner image, the second toner image having a same color as a color of the first toner image;

a transferring unit that performs a first transfer process in which the transferring unit transfers, onto the medium fed from the feeder, the first toner image, and performs a second transfer process in which the transferring unit transfers, onto the medium, the second toner image to cause the second toner image transferred onto the medium to overlap the first toner image transferred onto the medium, the second transfer process being performed without discharging, from a discharge opening, the medium onto which the first toner image is transferred;

a fixing unit that performs a first fixing process in which the fixing unit fixes, to the medium, the first toner image transferred onto the medium to form a first luminescent image, and performs a second fixing process in which the fixing unit fixes, to the medium, the second toner image transferred onto the medium to form a second luminescent image on the first luminescent image, with the second luminescent image overlapping the first luminescent image the second luminescent image having a same color as a color of the first luminescent image;

a conveyer unit that conveys the medium on which the first luminescent image and the second luminescent image are formed; and a discharge part having the discharge opening from which the medium conveyed by the conveyer unit is discharged.

2. The image forming apparatus according to claim 1, wherein the luminescent toner includes one or both of a fluorescent coloring agent and a fluorescent whitener.

3. The image forming apparatus according to claim 1, wherein the second luminescent image has a same color as a color of the first luminescent image.

4. The image forming apparatus according to claim 1, wherein the image data used in the second attachment process is the same as the image data used in the first attachment process.

5. The image forming apparatus according to claim 1, wherein a surface of the medium, on which the second luminescent image is to be formed, is the same as the surface of the medium, on which the first luminescent image is to be formed.

6. The image forming apparatus according to claim 1, wherein the luminescent toner used in the first attachment process and in the second attachment process comprises a fluorescent yellow toner.

7. The image forming apparatus according to claim 1, wherein the luminescent toner used in the first attachment process and in the second attachment process comprises a fluorescent magenta toner.

8. The image forming apparatus according to claim 1, wherein the developing unit further performs a third attachment process in which the developing unit attaches the luminescent toner to a third latent image that is formed on the basis of the image data, to form a third toner image, the transferring unit further performs a third transfer process in which the transferring unit transfers, onto the medium, the third toner image to cause the third toner image transferred onto the medium to overlap the second toner image transferred onto the medium, and the fixing unit further performs a third fixing process in which the fixing unit fixes, to the medium, the third toner image transferred onto the medium to form a third luminescent image on the second luminescent image, with the third luminescent image overlapping the second luminescent image.

9. An image forming method, comprising:

feeding a medium from a feeder that feeds the medium;

performing a first attachment process that attaches, with a developing unit, a luminescent toner to a first latent image that is formed on a basis of image data to form a first toner image;

performing a first transfer process that transfers, onto the medium fed from the feeder, the first toner image;

performing a first fixing process that fixes, to the medium, the first toner image transferred onto the medium to form a first luminescent image;

performing a second attachment process that attaches, with the developing unit used in the first attachment process, the luminescent toner to a second latent image that is formed on the basis of the image data used in the first attachment process, to form a second toner image, the second toner image having a same color as a color of the first toner image;

performing a second transfer process that transfers, onto the medium, the second toner image to cause the second toner image transferred onto the medium to overlap the first luminescent image, the second transfer process being performed without discharging, from a discharge opening, the medium on which the first luminescent image is formed;

performing a second fixing process that fixes, to the medium, the second toner image transferred onto the medium to form a second luminescent image on the first luminescent image and to cause the second luminescent image to overlap the first luminescent image, the second luminescent image having a same color as a color of the first luminescent image;

conveying, with a conveyer unit, the medium on which the first luminescent image and the second luminescent image are formed to the discharge opening of a discharge part; and discharging the medium to the discharge part from the discharge opening.

10. The image forming method according to claim 9, wherein the performing the second attachment process comprises using the luminescent toner having a same color as a color of the luminescent toner used upon the first attachment process.

11. The image forming method according to claim 9, wherein the performing the first attachment process comprises using a fluorescent yellow toner as the luminescent toner, and the performing the second attachment process comprises using the fluorescent yellow toner as the luminescent toner.

12. The image forming method according to claim 9, wherein the performing the first attachment process comprises using a fluorescent magenta toner as the luminescent toner, and the performing the second attachment process comprises using the fluorescent magenta toner as the luminescent toner.

13. The image forming method according to claim 9, wherein the second attachment process is performed on a basis of the image data that is the same as the image data used in the first attachment process.

14. The image forming method according to claim 9, wherein the second luminescent image is formed on a surface of the medium which is the same as the surface of the medium, on which the first luminescent image is formed.

* * * * *